US009116503B2

(12) United States Patent
Fukasawa et al.

(10) Patent No.: US 9,116,503 B2
(45) Date of Patent: Aug. 25, 2015

(54) DEVELOPING UNIT, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Yu Fukasawa, Tokyo (JP); Kazuo Chadani, Suntou-gun (JP); Kuniaki Hirukawa, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 158 days.

(21) Appl. No.: 13/861,565

(22) Filed: Apr. 12, 2013

(65) Prior Publication Data

US 2013/0272753 A1 Oct. 17, 2013

(30) Foreign Application Priority Data

Apr. 13, 2012 (JP) ..... 2012-091813

(51) Int. Cl.
*G03G 15/08* (2006.01)
*G03G 21/18* (2006.01)

(52) U.S. Cl.
CPC ..... *G03G 21/18* (2013.01); *G03G 15/0822* (2013.01); *G03G 21/186* (2013.01)

(58) Field of Classification Search
CPC ..... G03G 15/0806; G03G 15/0822; G03G 21/18; G03G 21/1857; G03G 21/186; G03G 21/1867; G03G 21/1871
USPC ..... 399/279
See application file for complete search history.

(56) References Cited

U.S. PATENT DOCUMENTS

| | | | | |
|---|---|---|---|---|
| 5,170,212 | A * | 12/1992 | DeCecca | 399/103 |
| 5,943,529 | A | 8/1999 | Miyabe et al. | |
| 5,966,567 | A | 10/1999 | Matsuzaki et al. | |
| 6,144,815 | A | 11/2000 | Chadani et al. | |
| 6,173,140 | B1 | 1/2001 | Suzuki et al. | |
| 6,173,145 | B1 | 1/2001 | Chadani et al. | |
| 6,178,302 | B1 | 1/2001 | Nagashima et al. | |
| 6,205,305 | B1 | 3/2001 | Suzuki et al. | |
| 6,219,504 | B1 | 4/2001 | Matsuzaki et al. | |
| 6,282,389 | B1 | 8/2001 | Matsuzaki et al. | |
| 6,301,457 | B1 | 10/2001 | Chadani et al. | |
| 6,473,585 | B2 | 10/2002 | Abe et al. | |
| 6,512,903 | B2 | 1/2003 | Chadani | |

(Continued)

FOREIGN PATENT DOCUMENTS

| | | | |
|---|---|---|---|
| JP | 4-55063 | U | 5/1992 |
| JP | 8-262826 | A | 10/1996 |

(Continued)

*Primary Examiner* — Erika J Villaluna
(74) *Attorney, Agent, or Firm* — Fitzpatrick, Cella, Harper & Scinto

(57) ABSTRACT

A developing unit for an electrophotographic image forming apparatus includes a developing roller, having a shaft member, for developing an electrostatic latent image formed on an electrophotographic photosensitive drum using a developer; and a bearing for rotatably supporting the shaft member, the bearing including a bearing base portion of a first resin molded material and a bearing portion of a second resin molded material different from the first resin molded material, the bearing portion having a through-hole, wherein the bearing portion includes a contact portion contacting a stepped abutting portion of the shaft member, and a retaining portion overlapping with the bearing base portion in a direction crossing with an axial direction of the shaft member.

13 Claims, 14 Drawing Sheets

(56) References Cited

U.S. PATENT DOCUMENTS

| | | | |
|---|---|---|---|
| 6,535,699 | B1 | 3/2003 | Abe et al. |
| 6,671,474 | B2 | 12/2003 | Chadani |
| 6,795,666 | B2 | 9/2004 | Miyabe et al. |
| 6,823,155 | B2 | 11/2004 | Tsuda et al. |
| 6,931,226 | B2 | 8/2005 | Chadani et al. |
| 6,934,485 | B2 | 8/2005 | Miyabe et al. |
| 6,980,759 | B2 | 12/2005 | Kanno et al. |
| 7,136,604 | B2 | 11/2006 | Chadani et al. |
| 7,184,682 | B2 | 2/2007 | Chadani et al. |
| 7,433,622 | B2 | 10/2008 | Chadani et al. |
| 7,499,663 | B2 | 3/2009 | Sato et al. |
| 7,570,900 | B2 | 8/2009 | Chadani et al. |
| 7,689,146 | B2 | 3/2010 | Sato et al. |
| 7,890,025 | B2 | 2/2011 | Chadani et al. |
| 7,899,364 | B2 | 3/2011 | Chadani et al. |
| 8,116,661 | B2 | 2/2012 | Chadani et al. |
| 8,160,478 | B2 | 4/2012 | Munetsugu et al. |
| 8,165,493 | B2 | 4/2012 | Chadani et al. |
| 8,306,460 | B2 | 11/2012 | Chadani et al. |
| 8,335,454 | B2 | 12/2012 | Chadani et al. |
| 8,355,648 | B2 | 1/2013 | Hirukawa et al. |
| 8,401,424 | B2 | 3/2013 | Suzuki et al. |
| 8,442,416 | B2 | 5/2013 | Chadani et al. |
| 8,447,209 | B2 | 5/2013 | Chadani et al. |
| 8,503,906 | B2 | 8/2013 | Suzuki et al. |
| 2003/0156855 | A1 | 8/2003 | Nittani et al. |
| 2009/0297208 | A1 | 12/2009 | Suzuki et al. |
| 2011/0280620 | A1 | 11/2011 | Chadani et al. |
| 2011/0280621 | A1* | 11/2011 | Suzuki et al. ..... 399/111 |
| 2012/0189343 | A1 | 7/2012 | Chadani et al. |
| 2012/0189344 | A1 | 7/2012 | Chadani et al. |
| 2012/0230726 | A1 | 9/2012 | Chadani et al. |
| 2012/0281999 | A1 | 11/2012 | Chadani et al. |
| 2013/0022368 | A1 | 1/2013 | Takarada et al. |
| 2013/0223853 | A1 | 8/2013 | Chadani et al. |
| 2013/0272727 | A1 | 10/2013 | Hirukawa et al. |

FOREIGN PATENT DOCUMENTS

| | | | |
|---|---|---|---|
| JP | 2003-241495 | A | 8/2003 |
| JP | 2004-205964 | A | 7/2004 |

* cited by examiner (a)

(b)

DEVELOPING UNIT, PROCESS CARTRIDGE AND ELECTROPHOTOGRAPHIC IMAGE FORMING APPARATUS

FIELD OF THE INVENTION AND RELATED ART

The present invention relates to a developing unit and a process cartridge. It relates also an electrophotographic image forming apparatus which uses a development unit and a process cartridge.

Here, an electrophotographic image forming apparatus means an apparatus which forms an image on recording medium with the use of an electrophotographic image formation method. Included in examples of an electrophotographic image forming apparatus are an electrophotographic copying machine, an electrophotographic printer (for example, laser beam printer, LED printer, etc.), a facsimile apparatus, a word processor, and the like.

A process cartridge means a cartridge in which a charging means, a developing means or a cleaning means, and the like, are integrally provided as processing means, along with an electrophotographic drum, and which is removably installable in the main assembly of an electrophotographic image forming apparatus. A main assembly of an electrophotographic image forming apparatus means what remains after the removal of a process cartridge from an electrophotographic image forming apparatus.

Further, a developing unit or development unit means a unit which develops an electrostatic latent image formed on an electrophotographic photosensitive drum, with the use of developer. It is one of the typical units of which a process cartridge is made.

A typical electrophotographic image forming apparatus which uses an electrophotographic image formation process employs a process cartridge system which integrally places an electrophotographic photosensitive drum, and processing means which processes an electrophotographic photosensitive drum, so that the drum and processing means can be removably installable in the main assembly of an electrophotographic image forming apparatus.

Referring to FIG. 2, an electrophotographic color image forming apparatus 100 is an example of an image forming apparatus which employs the above described process cartridge. It is of the so-called inline type. More specifically, it employs multiple process cartridges 7 (7*a*, 7*b*, 7*b* and 7*d*) which are arranged in a single line. It is desired that when the image forming apparatus 100 is not in use, the photosensitive drum and development roller of the process cartridge are kept separated from each other to prevent the problem that the deformation of the elastic layer of the development roller causes the apparatus 100 to output an image which is nonuniform in appearance. Thus, various combinations of a process cartridge and an image forming apparatus, which are provided with a mechanism for keeping the photosensitive drum and development roller from each other have been proposed. For example, one of the combinations is disclosed in Japanese Laid-open Patent Application 2003-241495.

SUMMARY OF THE INVENTION

Thus, the primary object of the present invention is to provide a development unit, and a process cartridge, which are equipped with bearing portions molded of two resinous substances different in composition; are inexpensive in structure; are equipped with an Oldham's coupling; can regulate the movement of the mechanical force input shaft of the development unit and the Oldham's coupling relative to each other, in terms of the direction parallel to the axial line of the input shaft; and are capable of preventing the actual bearing of the bearing portion from separating from the base portion of the bearing portion.

Another object of the present invention is to provide an electrophotographic image forming apparatus compatible with the development unit and process cartridge which are in accordance with the present invention.

According to an aspect of the present invention, there is provided a developing unit for an electrophotographic image forming apparatus, comprising a developing roller, having a shaft member, for developing an electrostatic latent image formed on an electrophotographic photosensitive drum using a developer; and a bearing for rotatably supporting said shaft member, said bearing including a bearing base portion of a first resin molded material and a bearing portion of a second resin molded material different from the first resin molded material, the bearing portion having a through-hole, wherein said bearing portion includes a contact portion contacting a stepped abutting portion of said shaft member, and a retaining portion overlapping with said bearing base portion in a direction crossing with an axial direction of the shaft member.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

Figure 2:
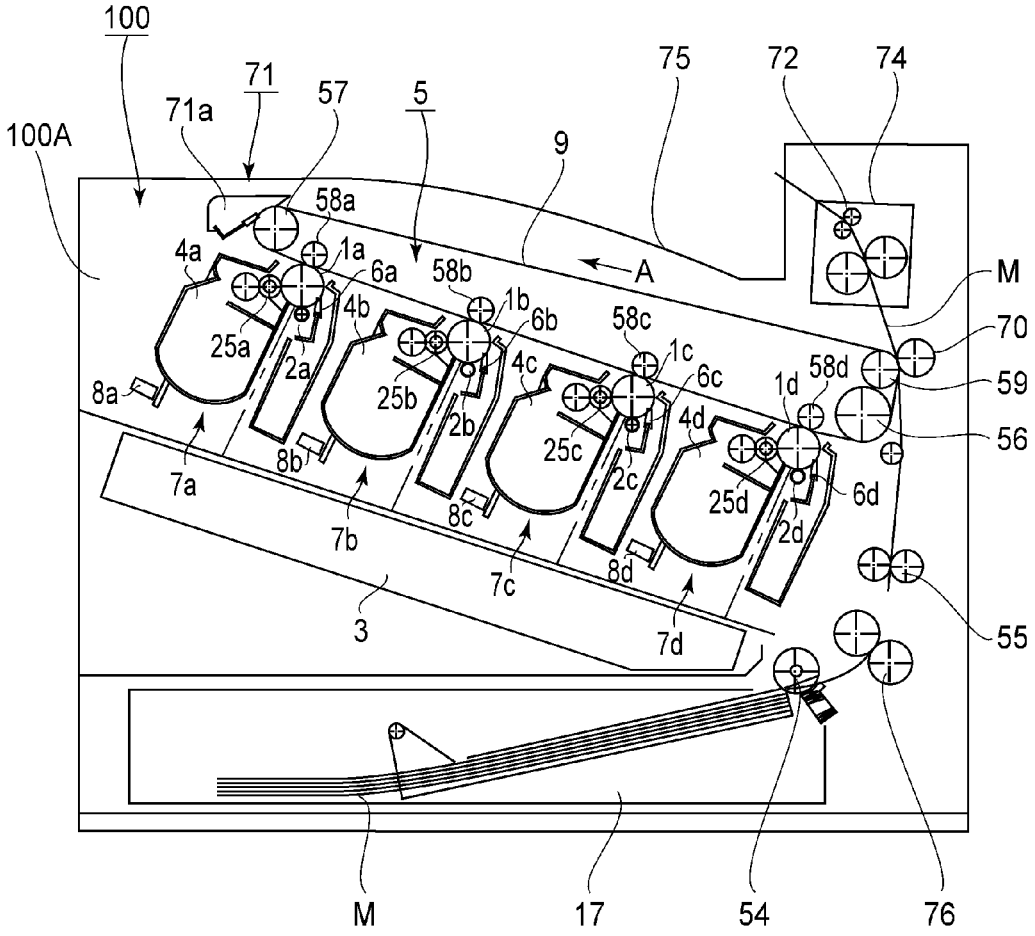
FIG. 2 is a schematic sectional view of a typical electrophotographic image forming apparatus to which the present invention is applicable. It shows the general structure of the apparatus.

Hereinafter, the present invention is concretely described with reference to the process cartridges and electrophotographic image forming apparatuses, which are in accordance with the present invention. FIG. 2 is a schematic sectional view of the electrophotographic image forming apparatus in this embodiment of the present invention, which is an electrophotographic color image forming apparatus. It shows the general structure of the apparatus.

(General Structure of Image Forming Apparatus)

Figure 12:
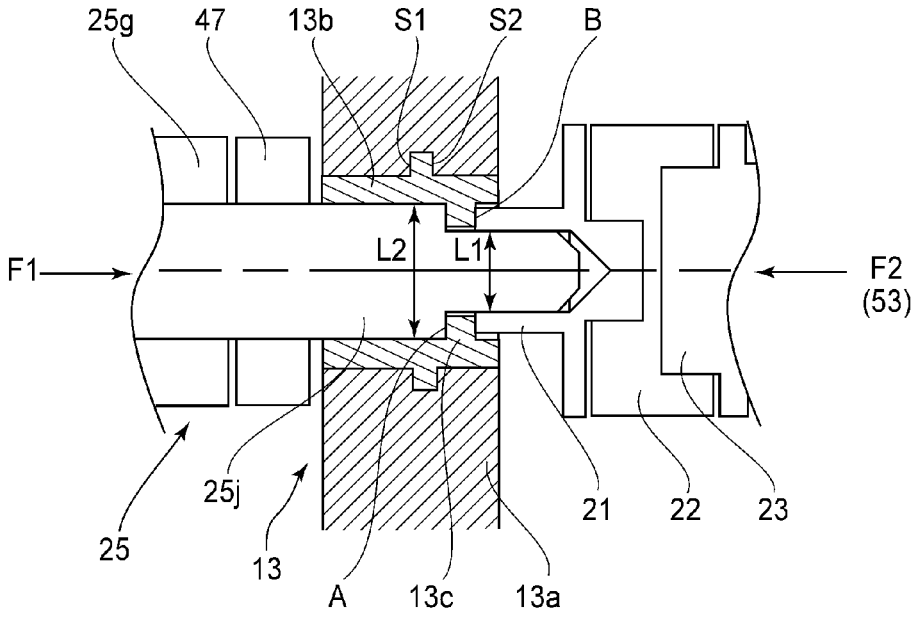
FIG. 12 is a schematic sectional view of the rear bearing for the development roller of the development unit in the second embodiment of the present invention, at a plane which coincides with the axial line of the development roller. It is for describing the structure of the development roller rear bearing.

First, the electrophotographic image forming apparatus 100 (which hereafter may be referred to simply as image forming apparatus) in this embodiment is described with regard to its general structure. Referring to FIG. 12, the image forming apparatus 100 employs four process cartridges 7 (7*a*, 7*b*, 7*c* and 7*d*), which are different in the color of the toner they use and are removably installable in the apparatus main assembly 100A. The four process cartridges 7 are mounted in the cartridge supporting members (unshown) in the apparatus main assembly 100A, being aligned in tandem, at a preset angle relative to the surface on which the apparatus main assembly 100A is positioned.

Each process cartridge 7 contains an electrophotographic photosensitive drum 1 (1*a*, 1*b*, 1*c* or 1*d*, which hereafter may be referred to simply as photosensitive drum 1). It contains also processing means such as a charging roller 2 (2*a*, 2*b*, 2*c* or 2*d*), a development roller 25 (25*a*, 25*b*, 25*c* or 25*d*), a cleaning member 6 (6*a*, 6*b*, 6*c* or 6*d*), etc., which are positioned in the adjacencies of the peripheral surface of the photosensitive drum 1, in a preset positional relationship.

The charge roller 2 is for uniformly charging the peripheral surface of the photosensitive drum 1. The development roller 25 is for developing a latent image formed on the peripheral surface of the photosensitive drum 1, into a visible image, with the use of developer (which hereafter may be referred to simply as toner). The cleaning member 6 is for removing the toner remaining on the peripheral surface of the photosensitive drum 1 after the transfer of the toner image formed on the photosensitive drum 1, onto a transfer belt 9 of the apparatus main assembly 100A.

Further, the process cartridge 7 has a scanner unit 3 for selectively exposing various points of the uniformly charged portion of the peripheral surface of the photosensitive drum 1 to form a latent image of the image to be formed, based on the information about the image to be formed, on the peripheral surface of the photosensitive drum 1. The scanner unit 3 is in the bottom portion of the process cartridge 7.

Further, the image forming apparatus 100 employs a cassette 17 for storing in layers multiple sheets M of recording medium. The cassette 17 is installed in the bottom portion of the apparatus main assembly 100A. The image forming apparatus 100 is also provided with a recording medium conveying means, which conveys each sheet M of recording medium upward of the apparatus main assembly 100A by way of a secondary transfer roller 70 and a fixation section 74, from the cassette 17. More specifically, the apparatus main assembly 100A is provided with: a recording medium conveyance roller 54 for feeding, one by one, the sheets M of recording medium in the cassette 17, into the apparatus main assembly 100A while separating each sheet M from the rest in the cassette 17; a pair of recording medium conveyance rollers 74 which convey further the sheet M of recording medium conveyed thereto by the recording medium conveyance roller 54; and a pair of registration rollers 55 which synchronize the conveyance of the sheet M of recording medium with the formation of a latent image on the photosensitive drum 1.

Further, the image forming apparatus 100 is provided with an intermediary transfer unit 5, as an intermediary transfer means, for transferring a toner image formed on the photosensitive drum 1 (1*a*, 1*b*, 1*c* or 1*d*). The intermediary transfer unit 5 is above the space for the process cartridges 7 (7*a*, 7*b*, 7*c* and 7*d*). It has a belt driving roller 56, an idler roller 57, a primary transfer roller 58 (58*a*, 58*b*, 58*c* or 58*d*), a belt backing roller 59, and a transfer belt 9. The primary transfer rollers 58 are positioned so that they oppose the photosensitive drums 1, one for one. The transfer belt 9 is suspended and kept stretched by the abovementioned rollers 56, 57 and 58. The belt backing roller 59 is positioned so that it opposes the secondary transfer roller 70 with the presence of the transfer belt 9 between itself and the secondary transfer roller 70.

The transfer belt 9 is circularly moved in the counterclockwise direction indicated by an arrow mark A while being kept in contact with all the photosensitive drums 1. The toner image on the photosensitive drum 1 is transferred (primary transfer) from the photosensitive drum 1 onto the transfer belt 9 by the application of voltage to the primary transfer roller 58 (58*a*, 58*b*, 58*c* or 58*d*). Then, the toner images on the transfer belt 9 are transferred (secondary transfer) onto the sheet M of recording medium by the application of voltage between the belt backing roller 59 (which is on inward side of belt loop), and the secondary transfer roller 70.

The image forming operation by the image forming apparatus 100 in this embodiment is as follows: While the photosensitive drum 1 is rotated, the peripheral surface of the photosensitive drum 1 is uniformly charged by the charge roller 2. Then, the various points of the uniformly charged portion of the peripheral surface of the photosensitive drum 1 are selectively exposed by the scanner unit 3. Thus, an electrostatic latent image is formed on the peripheral surface of the photosensitive drum 1. The latent image is developed into a toner image by the development roller 25; four toner images (developer images), which are different in color, are formed on the peripheral surface of the four photosensitive drums 1, one for one. In synchronism with the formation of the toner images, a sheet M of recording medium is conveyed by the pair of registration rollers 55 to the secondary transfer position where the secondary transfer roller 70 opposes the belt backing roller 59 with the presence of the transfer belt 9 between the two rollers 70 and 59.

Then, the four developer (toner) images, different in color, on the transfer belt 9, are transferred onto the sheet M of recording medium by the application of transfer bias to the secondary transfer roller 70. Consequently, a full-color image is effected on the sheet M of recording medium. After the formation of the full-color image on the sheet M of recording medium, the sheet M and the toner images thereon are subjected to heat and pressure by the fixation section 74. Consequently, the developer images become fixed to the sheet M. Thereafter, the sheet P is discharged into a delivery tray 75 by a pair of discharge roller 72. Incidentally, the fixation section 7 is in the top portion of the apparatus main assembly 100A.

As for the toner which failed to be transferred (secondary transfer) onto a sheet M of recording medium, and therefore, is remaining on the transfer belt 9, is conveyed by the subsequent movement of the belt 9 to an intermediary transfer belt cleaning unit 71, in which it is removed from the belt 9 and is stored in a removed toner storage chamber 71*a*.

(Process Cartridge)

Figure 3:
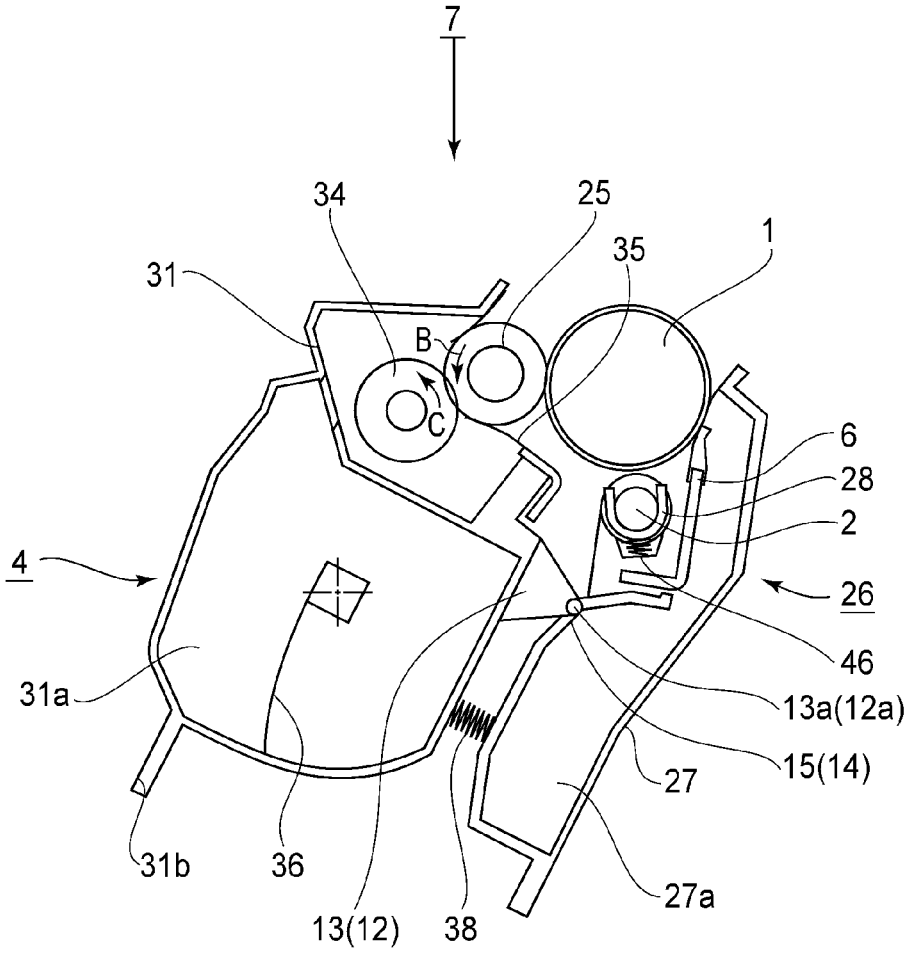
FIG. 3 is a schematic sectional view of a typical process cartridge in accordance with the present invention.
Figure 4:
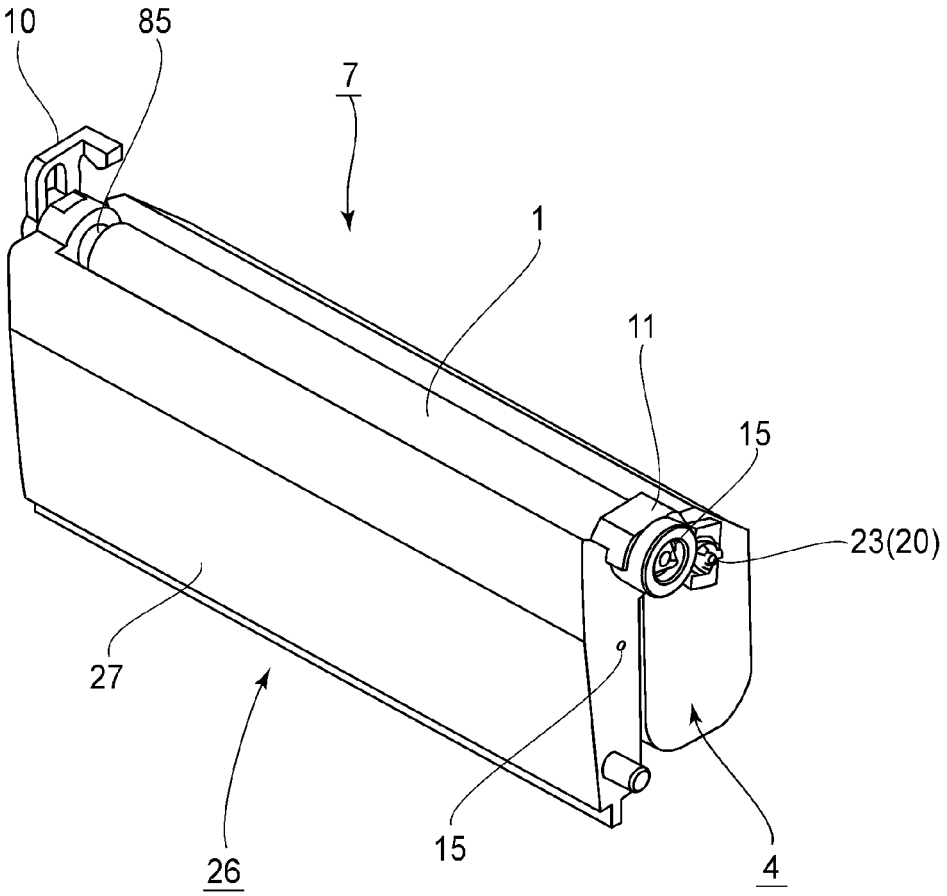
FIG. 4 is an external perspective view of the process cartridge in accordance with the present invention.
Figure 5:
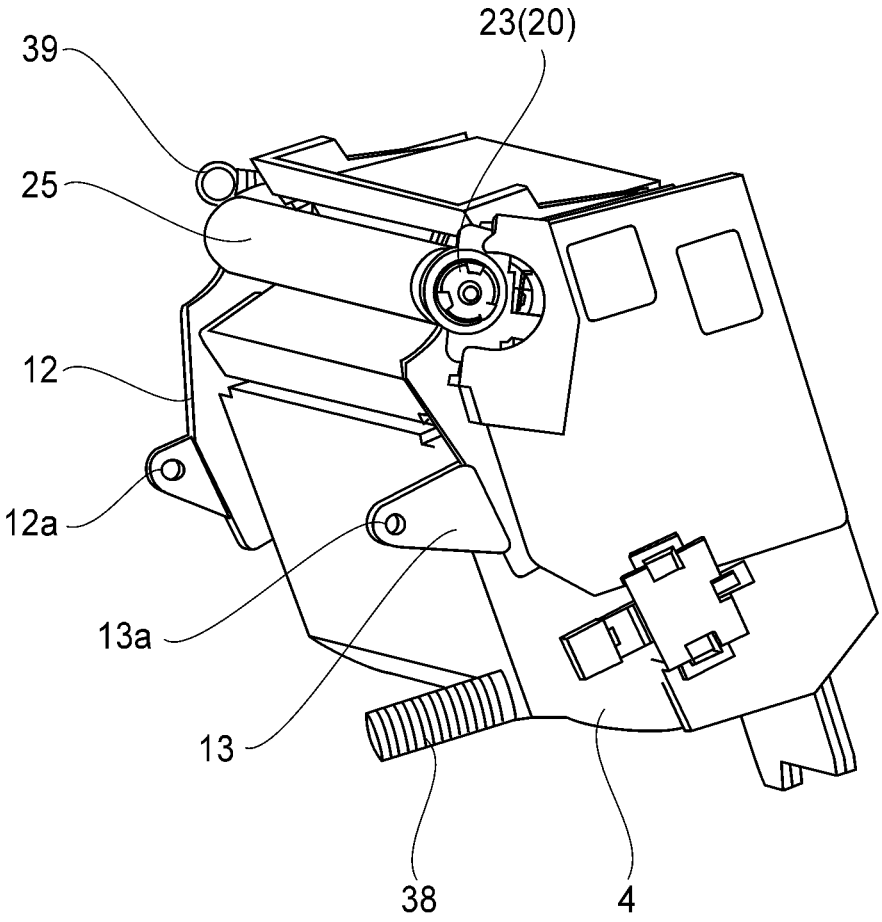
FIG. 5 is a perspective view of the development unit in the first embodiment of the present invention.

Next, referring to FIGS. 3, 4 and 5, the process cartridge 7 in this embodiment is described. FIG. 3 is a schematic sectional view of the process cartridge in this embodiment, at a plane perpendicular to the lengthwise direction of the cartridge, when toner (developer) is present in the cartridge. The cartridge 7*a* which stores yellow toner, cartridge 7*b* which stores magenta toner, and cartridges 7*c* and 7*d* which store cyan and black toners, respectively, are the same in structure.

The process cartridge 7 (7*a*, 7*b*, 7*c* and 7*d*) is made up of a cleaning unit (drum unit) 26 (26*a*, 26*b*, 26*c* and 26*d*), as the first unit, and a development unit 4 (4*a*, 4*b*, 4*c* and 4*d*), as the second unit. The cleaning unit 26 is equipped with the photosensitive drum 1 (1*a*, 1*b*, 1*c* or 1*d*), charge roller 2 (2*a*, 2*b*, 2*c* or 2*d*), and cleaning member 6 (6*a*, 6*b*, 6*c* or 6*d*). The development unit 4 is equipped with the development roller 25.

The photosensitive drum 1 is rotatably attached to the frame 27 of the cleaning unit 26, with the placement of the front and rear bearings for the photosensitive drum 1 between the photosensitive drum 1 and the frame 27. One of the lengthwise ends of the photosensitive drum 1 is provided with a drum coupling 16 and a flange 85. The charge roller 2 and cleaning member 6 are in the adjacencies of the peripheral surface of the photosensitive drum 1 as described above. Further, as the residual toner on the peripheral surface of the photosensitive drum 1 is removed by the cleaning member 6, it falls into the chamber 27*a* for the removed toner.

In an image forming operation, the photosensitive drum 1 is rotationally driven by the transmission of the drum driving force to the drum coupling 16 of the cleaning unit 26 from the motor (unshown mechanical power source) with which apparatus main assembly 100A is provided. The charge roller 2 is rotatably supported by the cleaning unit frame 27 with the placement of a pair of charge roller bearings 28 between the charge roller 2 and frame 27, with charge roller 2 kept pressed toward the axial line of the photosensitive drum 1 by a pair of charge roller pressing members 46. It is rotated by the rotation of the photosensitive drum 1.

The development unit 4 is made up of the development roller 25 which rotates in contact with the photosensitive drum 1, in the direction indicated by an arrow mark B, and the development unit frame 31 which supports the development roller 25. The development roller 25 is rotatably supported by the development unit frame 31 with the placement of front and rear bearings 12 and 13 between the front and rear ends, respectively, of the development unit frame 31.

The development unit 4 is provided with a toner supply roller 34 and a development blade 35, in addition to the development roller 25. The toner supply roller 34 and development blade 35 are in the adjacencies of the peripheral surface of the development roller 25. The toner supply roller 34 is for supplying the peripheral surface of the development roller 25 with developer (toner). It rotates in contact with the development roller 25, in the direction indicated by an arrow mark C. The development blade 35 is for regulating the toner layer on the peripheral surface of the development roller 25. Incidentally, this embodiment is not intended to limit the present invention in terms of the direction in which the development roller 25 and toner supply roller 34 are rotated. Further, the development unit 4 is provided with a toner conveyance member 36, which is in the toner storage portion 31*a* of development unit frame 31 to convey the toner in the toner storage portion 31*a* to the above described toner supply roller 34.

The cleaning unit 26 and development unit 4 are connected to each other in such a manner that they are allowed to pivot about their joints. More specifically, the front and rear bearings 12 and 13 for the development roller 25 are provided with connection holes 12*a* and 13*a*, into which the development unit supporting front and rear pins 14 and 15 pressed into the cleaning unit frame 27 fit. Thus, the cleaning unit 26 and development unit 4 are attached to each other in such a manner that the development unit 4 can be pivotally moved relative to the cleaning unit 26 about the front and rear supporting pins 14 and 15.

As for the cleaning unit 26, it is provided with front and rear bearings 10 and 11 which are attached to the cleaning unit frame 27 for rotatably supporting the photosensitive drum 1. Further, the cleaning unit 26 is provided with a drum coupling 16 and a flange 85. The drum coupling 16 is for transmitting the rotational driving force (first rotational driving force) from the motor of the apparatus main assembly 100A, to the photosensitive drum 1 attached to the photosensitive drum 1. It is supported by the rear drum bearing 11. The flange 85 is supported by the front drum bearing 10.

Referring to FIG. 5, the process cartridge 7 and apparatus main assembly 100A are structured so that during an image forming operation, the development unit 4 is kept pressed upon the cleaning unit 26 by a pair of compression springs 38 with which the development unit frame 31 is provided, and a pair of tension springs 39 with which the front bearing 12 for the development roller 25 is provided. The compression springs 38 and tension springs 39 generate the force for keeping the development roller 25 in contact with the photosensitive drum 1 while allowing development unit 4 to pivot about the aforementioned development unit supporting pins 14 and 15 put through the holes 12*a* and 13*a* of the front and rear bearings 12 and 13, respectively, for the development roller 25.

In the contact development method in which the development roller 25 is placed in contact with the photosensitive drum 1, it is desired that the photosensitive drum 1 is rigid whereas the development roller 25 is elastic. As one of the methods for providing the development roller 25 with elasticity, the core of the development roller 25 may be covered with a layer of solid rubber. In consideration of the fact that the development roller 25 is required to charge toner, the layer of solid rubber may be coated with resin.

Next, the sequential steps carried out by the process cartridge 7 during an image forming operation are described. After the installation of the process cartridges 7 (7*a*, 7*b*, 7*c* and 7*d*) into their preset positions in the apparatus main assembly 100A by the process cartridge installation member, the cleaning unit 26 is immovably held to the apparatus main assembly 100A by the process cartridge (cleaning unit) positioning portion of the apparatus main assembly 100A. The development unit 4 remains held to the cleaning unit 26, being enabled to pivotally move about the supporting pins 14 and 15, relative to the cleaning unit 26.

Further, when each cartridge 7 is immovably held in its preset position in the apparatus main assembly 100A, the driving force transmitting first member 66 (which will be described later) of the apparatus main assembly 100A is in engagement with the drum coupling 16 of the cleaning unit 26, and the driving force transmitting second member 53 (which also will be described later) of the apparatus main assembly 100A is in engagement with the development unit driving force input portion 20 (which will be described later) of the development unit 4.

During a period in which no image is formed, the development unit 4 (4*a*, 4*b*, 4*c* or 4*d*) of the process cartridge 7 is kept in a preset position (separation position) in which the development roller 25 is kept separated from the photosensitive drum 1 in the cleaning unit 26 by the pressure applied to the pressure bearing portion 31*b* (FIG. 3) of the development unit frame 31 by the pressure applying member 8 (8*a*, 8*b*, 8*c* or 8*d*) of the apparatus main assembly 100A. That is, the development roller 25 is pivoted against the forces generated by the pair of compression springs 38 and tension springs 39, about the development unit supporting pins 14 and 15, in the direction to separate the development roller 25 from the photosensitive drum 1, into the separation position, and kept in the separation position, by the development unit pressing members 8.

During a period in which an image is formed, the pressure applied to the pressure bearing portion 31*b* of the development unit frame 31 by the development unit pressing member 8 is removed, so that the development unit 4 is pivoted back into, and kept in, a preset position (contact position) in which the development roller 25 is kept in contact with the photosensitive drum 1 by the preset amount of pressure generated by the combination of the pair of compression springs 38 and pair of tension springs 39. That is, the development roller 25 is pivoted about the development unit supporting pins 14 and 15, into the contact position, and kept in the contact position, by the force generated by the combination of the pair of compression springs 38 and pair of tension springs 39.

As the information about the image to be formed is sent to the image forming apparatus 100, the motor (unshown) of the apparatus main assembly 100A begins to be rotated, and the rotational driving force from the motor is transmitted to the photosensitive drum 1, development roller 25, toner supply roller 34, and toner conveying member 36. Further, charge bias is applied to the charge roller 2 from the electrical power source (unshown) of the apparatus main assembly 100A, whereby the peripheral surface of the photosensitive drum 1 is uniformly charged. Then, the uniformly charged portion of the peripheral surface of the photosensitive drum 1 is exposed by the scanner unit, in accordance with the information about the image to be formed. Consequently, a latent image of the image to be formed is effected on the uniformly charged portion of the peripheral surface of the photosensitive drum 1.

Meanwhile, the toner in the toner storage portion 31*a* is sent to the toner supply roller 34 by the rotation of the toner conveying member 36. Thus, as the toner supply roller 34 is rotated, the peripheral surface of the rotating development roller 25 is supplied with toner. As the peripheral surface of the development roller 25 is supplied with toner, the toner on the development roller 25 is frictionally charged by the development blade 35.

Then, development bias is applied to the development roller 25 from the electrical power source (unshown) of the apparatus main assembly 100A to develop the electrostatic latent image on the peripheral surface of the photosensitive drum 1. The process cartridge 7 and apparatus main assembly 100A are structured so that after the proper installation of the process cartridge 7 into the apparatus main assembly 100A, the development roller 25 opposes the photosensitive drum 1 in such a manner that the development roller 25 develops the electrostatic latent image formed on the peripheral surface of the photosensitive drum 1, by being placed in contact with the peripheral surface of the photosensitive drum 1.

(Structure of Development Unit Driving Force Input Shaft and Development Unit Driving Force Input Portion of Process Cartridge)

Figure 6:
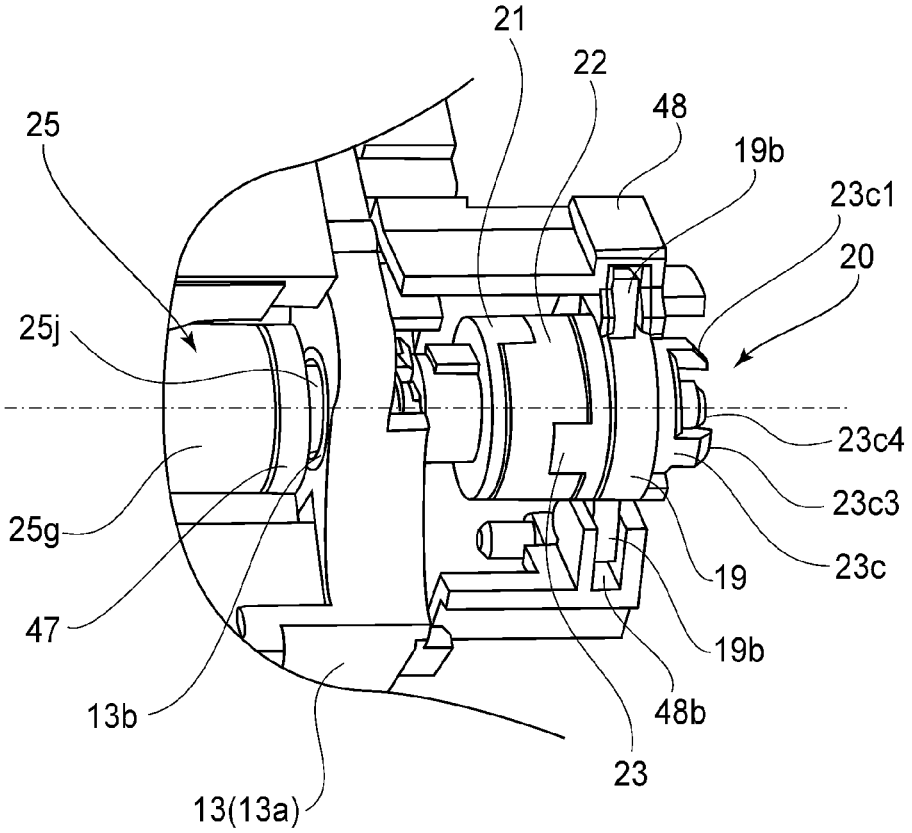
FIG. 6 is a partially broken perspective view of the rear end portion of the development unit in the first embodiment. It shows the structural arrangement for supporting the development roller.

Next, referring to FIGS. 6-10, the structural arrangement for supporting the development unit driving force input shaft (shaft-shaped member) of the process cartridge 7 in accordance with the present invention, and the structure of the development unit driving force input portion of the process cartridge 7 are described. FIG. 6 shows the rear end portion of the development roller supporting portion of the development unit 4, which has the development unit driving force input shaft.

In this embodiment, the development unit driving force input shaft for transmitting the driving force from the motor of the apparatus main assembly 100A to the development unit 4 is a development roller shaft 25*j* of the development roller 25. Hereafter, the development unit driving force input shaft is referred to as "development roller shaft 25*j*". Incidentally, this embodiment is not intended to limit the present invention in terms of the structural arrangement for transmitting the driving force from the motor of the apparatus main assembly 100A to the development unit 4. That is, the development unit driving force input shaft does not need to be the development roller shaft 25*j*.

Referring to FIG. 6, the development roller shaft 25*j* of the development roller 25 is rotatably put through the through hole of the through hole portion (bearing portion having the through hole) 13*b* of the development roller rear bearing 13. The structure of the through hole portion 13*b* of the development roller rear bearing 13 is described later. The development unit 4 is provided with a roller 47 for regulating the amount of contact between the development roller 25 and photosensitive drum 1. The roller 47 is fitted around the development roller shaft 25*j*, and is between the rubber roller portion 25*g* of the development roller 25 and the development roller rear bearing 13.

Here, only the structural arrangement for supporting one of the lengthwise ends of the development roller 25 is described. The structural arrangement for supporting the other lengthwise end (front end) of the development roller 25 is the same as the one that supports the rear end. That is, the development roller front bearing is an integral part of the development supporting front member, and is fitted around the other (front) end portion of the development roller shaft 25*j* to rotatably support the development roller 25. Also in this embodiment, the development unit driving force input portion of the development unit 4 employs an Oldham's coupling 20, as a shaft coupling member (force transmitting member), which is for transmitting the development unit driving force from the driving force transmitting member 53 of the apparatus main assembly 100A to the development roller shaft 25*j* while tolerating the misalignment between the axial line of the development unit driving force transmitting member 53 of the apparatus main assembly 100A and the axial line of the development roller shaft 25*j*.

Figure 7:
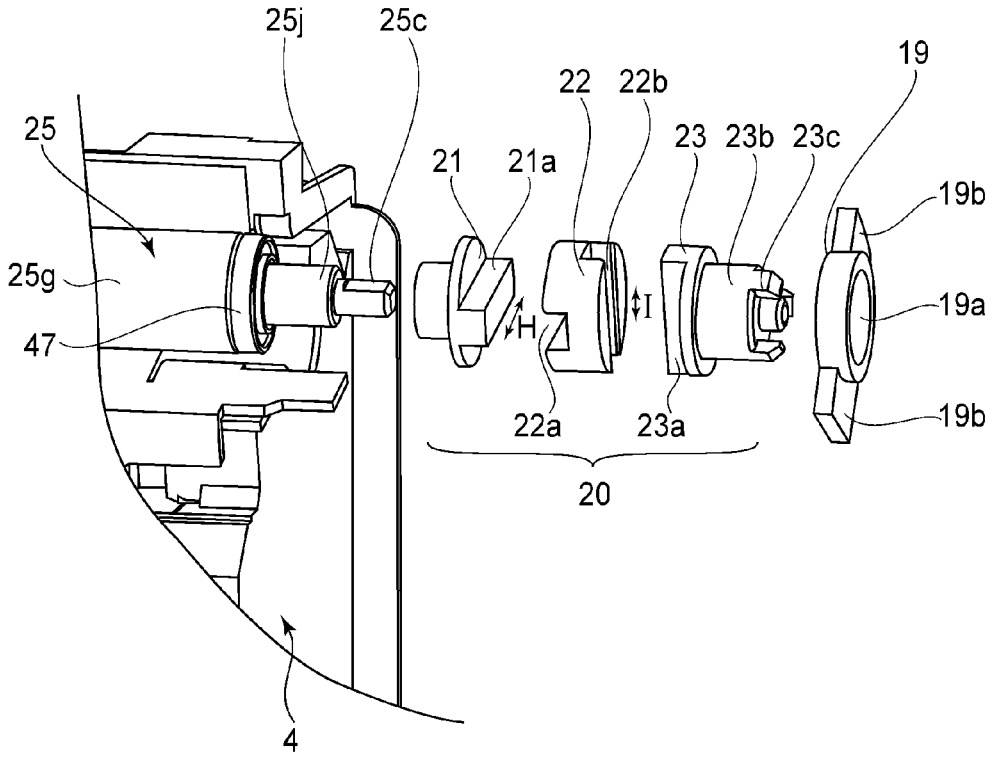
FIG. 7 is a combination of a perspective view of the rear end portion of the development unit and an exploded perspective view of the development roller shaft coupling, in the first embodiment.
Figure 8:
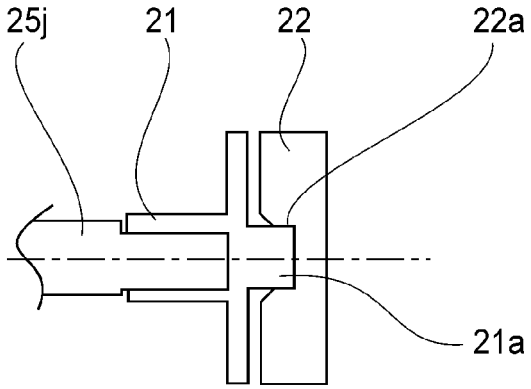
FIG. 8 is a schematic sectional view of a combination of the development roller shaft, and follower and intermediary portions of the development roller shaft coupling, in the first embodiment.
Figure 8:
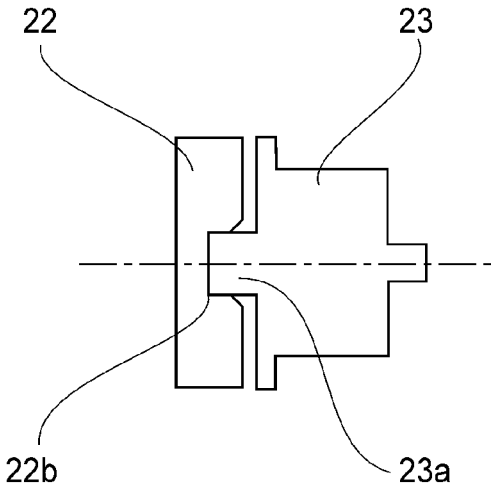

Next, referring to FIGS. 7 and 8, the structure of the Oldham's coupling 20 is described. FIG. 7 which is for describing the structure of the Oldham's coupling 20 does not show the development roller rear bearing 13. Referring to FIG. 7, the Oldham's coupling 20 is made up of a follower portion 21, an intermediary portion 22, and a driving portion 23. The rear end portion of the development roller shaft 25*j* is provided with a D-cut portion 25*c*. The follower portion 21 is provided with a hole (unshown) which is similar in shape to the D-cut portion 25*c* of the development roller 25. Thus, the D-cut portion 25*c* of the development roller shaft 25*j* is allowed to fit into the hole of the follower portion 21, enabling thereby the driving force to be transmitted from the follower portion 21 to the development roller shaft 25*j*.

The shaft portion 23*b* of the driving portion 23 of the Oldham's coupling 20 is fitted in the hole 19*a* of the coupling holding member 19, being thereby rotatably supported by the coupling holding member 19. Further, the driving portion 23 is provided with projections which engage with the development unit coupling 53 (FIG. 10) of the apparatus main assembly 100A, which is the driving force transmitting second member of the apparatus main assembly 100A, which will be described later.

Next, referring to FIG. 8, which is a schematic sectional view of the Oldham's coupling 20, the structure of the Oldham's coupling 20 is described in detail. FIGS. 8(*a*) and 8(*b*) are schematic sectional views of the Oldham's coupling 20, at a plane perpendicular to the direction indicated by an arrow mark H in FIG. 7, and a plane perpendicular to the direction indicated by an arrow mark I in FIG. 7, respectively. Referring to FIG. 8(*a*), the follower portion 21 of the coupling 20 is provided with a rib 21*a*, which is an integral part of the follower portion 21. The intermediary portion 22 of the coupling 20 is provided with a groove 22*a*, in which the rib 21*a* of the follower portion 21 fits in such a manner that the follower portion 21 and intermediary portion 22 are allow to move relative to each other in the direction indicated by the arrow mark H in FIG. 7. Referring to FIG. 8(*b*), the driving portion 23 of the coupling 20 is provided with a rib 23*a*, which is an integral part of the driving portion 23. The intermediary portion 22 of the coupling 20 is provided with a groove 22*b*, in which the rib 23*a* fits in such a manner that the intermediary portion 22 and driving portion 23 are allowed to move relative to each other in the direction indicated by the arrow mark I in FIG. 7.

Figure 9:
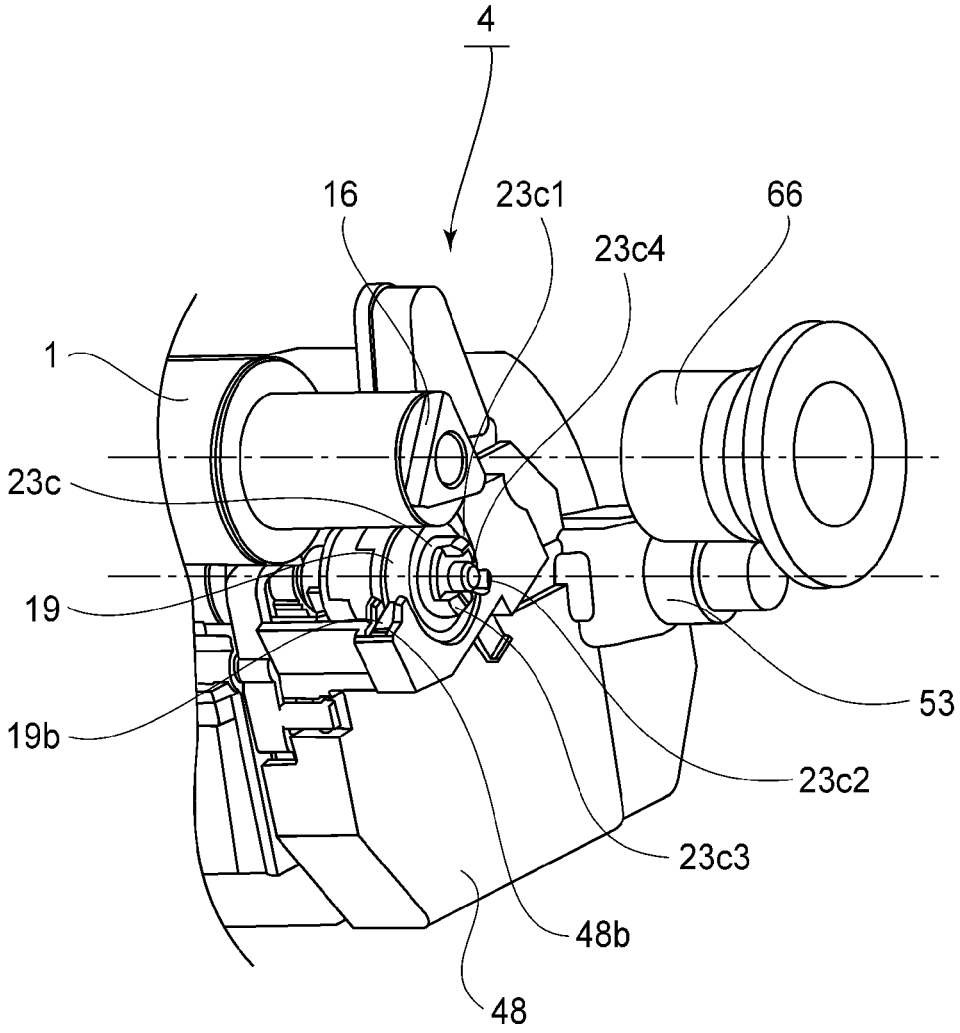
FIG. 9 is a partially broken perspective view of the couplings of the development unit in the first embodiment.

FIG. 9 is a drawing for showing the structure of the couplings of the process cartridge 7. The outwardly facing surface of the driving portion 23 of the Oldham's coupling 20 of the development unit 4 is provided with projections 23*c*1-23*c*3 which project in the direction parallel to the axial line of the driving portion 23. The inwardly facing surface of the driving portion 23 of the Oldham's coupling 20 is provided with a centering boss 23*c*4 which is for aligning the development roller shaft 25*j* with the development coupling 53 of the apparatus main assembly 100A. The centering boss 23*c*4 projects in the direction parallel to the axial line of the driving portion 23. The one end (rear end) of the axle of the photosensitive drum 1 is provided with the drum coupling 16.

Further, the guiding portion 19*b* of the coupling holding member 19 is guided in the direction perpendicular to the axial line of the development roller 25, by a groove 48*b* of the side cover 48 solidly attached to the development unit 4 with the use of small screws or the like.

Figure 10:
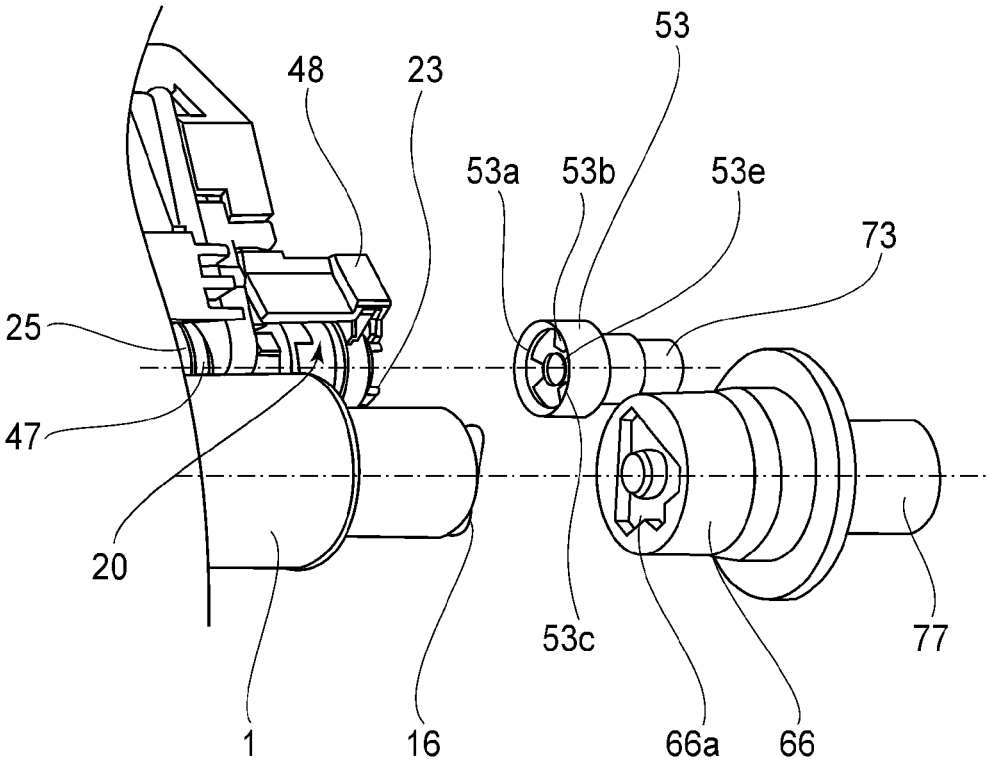
FIG. 10 is a perspective view of the first and second couplings on the main assembly side of the image forming apparatus, and the corresponding couplings of the development unit, in the first embodiment.

FIG. 10 is a drawing for showing the structure of the couplings of the apparatus main assembly 100A. Referring to FIG. 10, the development unit coupling 53 of the apparatus main assembly 100A, which is the second driving force transmitting member of the apparatus main assembly 100A for transmitting driving force from the apparatus main assembly 100A to the development roller 25, is provided with holes 53*a*-53*c*.

The development coupling 53 of the main assembly 100A is kept pressed toward the process cartridge 7 by a development unit coupling pressing member 73, such as a compression spring, of the apparatus main assembly 100A, in such a manner that it is movable in the direction parallel to the axial line of the development roller 25. It sometimes occurs that when the process cartridge 7 is installed into the apparatus main assembly 100A, the Oldham's coupling 20 of the development unit 4 comes into contact with the development unit coupling 53 of the apparatus main assembly 100A in such a manner that the projections 23*c*1-23*c*3 of the driving portion 23 of the Oldham's coupling 20 do not align with the holes 53*a*-53*c* of the development unit coupling 53 of the apparatus main assembly 100A. In such a case, the development unit coupling 53 of the apparatus main assembly 100A is allowed to retract, because of the above-described structural arrangement.

As the aligning boss 23*c*4 of the driving portion 23 fits into the aligning hole 53*e* of the development unit coupling 53 of the apparatus main assembly 100A, the rotational axis (axial line) of the driving portion 23 of the Oldham's coupling 20 becomes aligned with the rotational axis (axial line) of the development unit coupling 53 of the apparatus main assembly 100A. Thus, as the development unit coupling 53 of the apparatus main assembly 100A is rotated, the projections 23*c*1-23*c*3 of the driving portion 23 of the Oldham's coupling fit into the holes 53*a*-53*c* of the development unit coupling 53 of the apparatus main assembly 100A. Consequently, the rotational driving force is transmitted to the development roller 25.

The drum driving coupling 66 of the apparatus main assembly 100A, as the driving force transmitting first member of the apparatus main assembly 100A, which is for transmitting driving force to the photosensitive drum 1 from the apparatus main assembly 100A, is the same in structure as the development unit engaging coupling 53 of the apparatus main assembly 100A. The drum driving coupling 66 is provided with a hole 66*a*.

The drum driving coupling 66 is kept pressed toward the process cartridge 7 by a drum driving coupling pressing member 73, such as a compression spring, in such a manner that the drum driving coupling 66 is allowed to move in the direction parallel to the axial line of the photosensitive drum 1. It occurs sometimes that when the process cartridge 7 is installed into the apparatus main assembly 100A, the drum coupling 16 of the development unit 4 comes into contact with the drum unit driving coupling 66 of the apparatus main assembly 100A in such a manner that the projection of the drum coupling 16 does not align with the hole 66*a* of the drum driving coupling 66. In such a case, the drum driving coupling 66 is allowed to retract, because of the above described structural arrangement.

Therefore, as the drum driving coupling 66 is rotated, the projection of the drum coupling 16 fits into the hole 66*a* of the drum driving coupling 66. Consequently, the rotational driving force is transmitted to the photosensitive drum 1.

The force for driving the drum driving coupling 66 (as driving force transmitting first member) of the apparatus main assembly 100A, and the force for driving the development unit driving coupling 53 (as driving force transmitting second member) of the apparatus main assembly 100A, are transmitted from the motor (unshown) located in the apparatus main assembly 100A. The present invention is applicable to an electrophotographic image forming apparatus regardless of whether the apparatus main assembly 100A is structured so that each process cartridge 7 is rotated by a motor dedicated to the cartridge 7 or multiple process cartridges 7 are rotated by a single motor.

(Structure of Through Hole Portion of Development Unit Rear Bearing of Process Cartridge)

Next, the structure of the development roller rear bearing 13 of the process cartridge 7 is described with regard to its through hole portion 13*b*.

Referring to FIG. 6, the development roller shaft 25*j* of the development roller 25 is put through the through hole of the through hole portion 13*b* of the development roller rear bearing 13, being thereby rotatably supported by the bearing 13. Although FIG. 6 shows only the developer roller rear bearing 13 for the development roller 25, in terms of the lengthwise direction of the process cartridge 7, how the front end of the development roller shaft 25*j* of the development roller 25 is rotatably supported by the development unit frame 31 is similar to how the rear end of the development roller shaft 25*j* of the development roller 25 is rotatably supported by the development unit frame 31, as shown in FIG. 5. More specifically, the development roller shaft 25*j* is put through the through hole (unshown) of the development roller front bearing 12, being thereby rotatably supported by the development roller supporting front bearing 12. The development roller 25 is held to the development unit 4 by the solid fixation of the aforementioned bearing to the development unit frame 31, with the use of screws or the like means.

Figure 1:
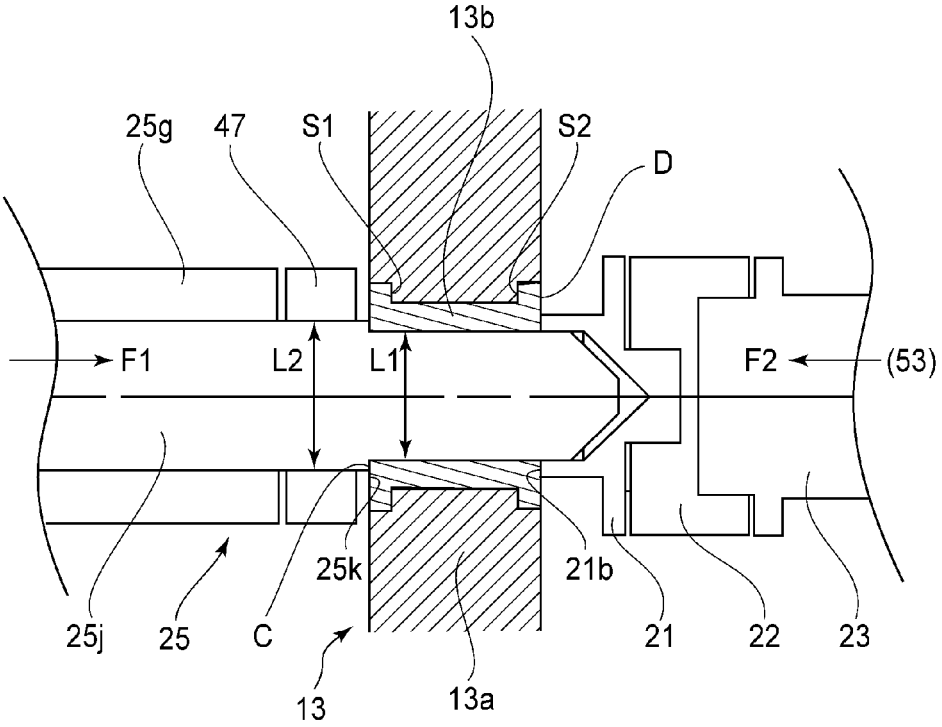
FIG. 1 is a sectional view of a combination of the rear bearing for the development roller, the rear end portion of the development roller, and development roller shaft coupling, in the first embodiment of the present invention, at a plane which coincides with the axial line of the development roller. It describes the structure for regulating the development roller (development roller shaft) movement in the direction parallel to the axial line of the development roller.

FIG. 1 is a sectional view of a combination of the rear bearing 13 for the development roller 25, the rear end portion of the development roller 25, and development roller shaft coupling, in the first embodiment of the present invention, at a plane which coincides with the axial line of the development roller 25, in FIG. 6. As will be evident from FIG. 1, the development roller rear bearing 13 is formed in a single piece, of no less than two resinous substances which are different in composition, with the use of a two color molding method.

In this embodiment, the base portion 13*a* (as first portion) of the development roller rear bearing 13 is formed of dielectric polyethylene resin, in consideration of strength and cost, whereas the through hole portion 13*b* (as second portion) of the development roller rear bearing 13 is formed of electrically conductive polyacetal resin (which contains carbon black), which is excellent in terms of electrical conductivity, and also, in terms of the friction between the bearing 13 and the development roller shaft 25*j*, and the friction between the bearing 13 and points of contact of the apparatus main assembly 100A. That is, the material for the base portion 13*a* (as first portion) of the development roller rear bearing 13 is different in composition from the material for the through hole portion 13*b* (as second portion) of the development roller rear bearing 13. However, this embodiment is not intended to limit the present invention in terms of the type and number of the resinous substance as the material for the development roller rear bearing 13, and the method for forming the development roller rear bearing 13.

Figure 11:
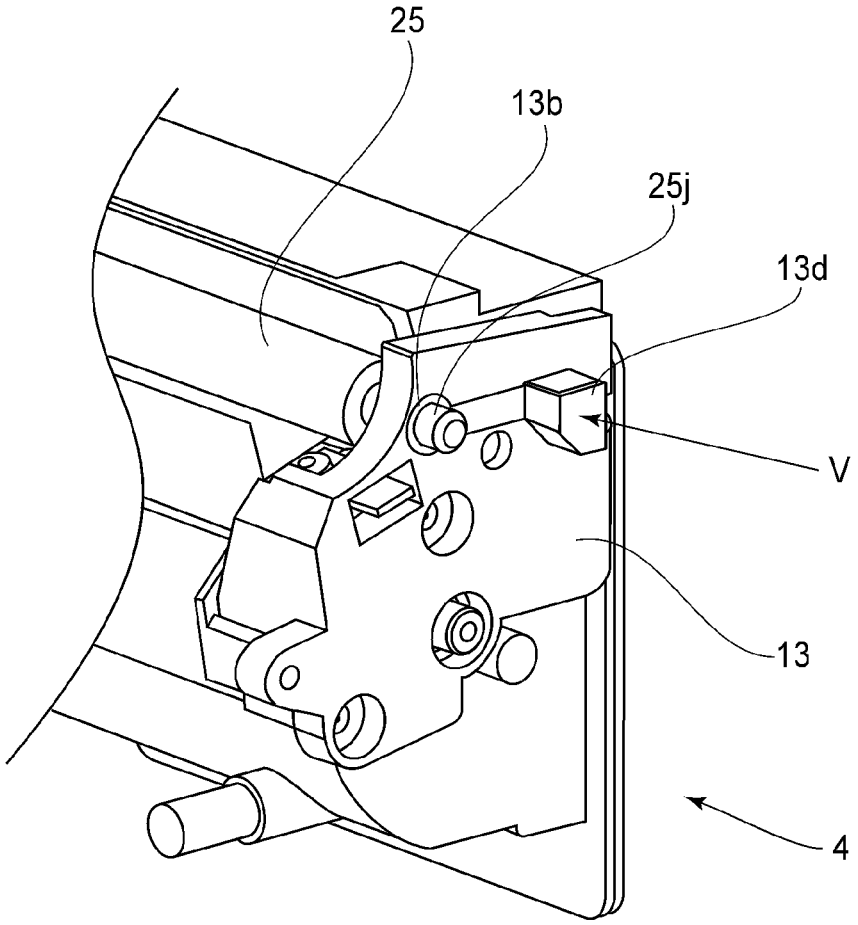
FIG. 11 is a perspective view of the rear end portion of the development unit in the first embodiment. It is for describing the structure and positioning of the electrical contact for the development roller.

FIG. 11 shows an example of the development roller rear bearing 13, which was molded of two electrically conductive substances different in composition. In order to allow electricity to flow between the through hole portion 13*b* and electrical contact portion 13*d* of the development roller rear bearing 13, the through hole portion 13*b* and electrical contact portion 13*d* are formed in a single piece, of electrically conductive resin. The electrical connection between the electrical contact portion 13*d* and development roller shaft 25*j* is established by the insertion of the development roller shaft 25*j* into the through hole of the through hole portion 13*b*.

Figure 13:
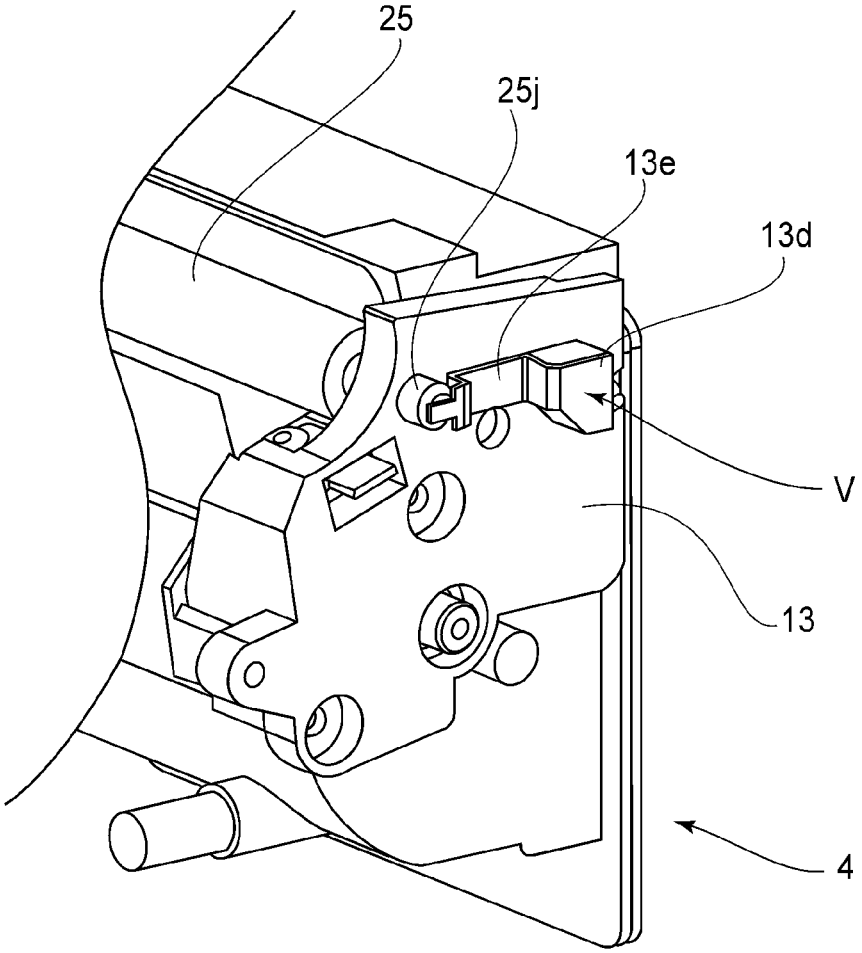
FIG. 13 is a perspective view of a conventional rear bearing portion for the development roller of the development unit. It is for describing the structure and positioning of the electrical contact of the bearing.

FIG. 13 shows an example of conventional development roller rear bearing 13, which employs a piece of electrically conductive plate placed in contact with the development roller shaft 25*j* and electrical contact portion (13*d*) of the development roller rear bearing 13 to establish electrical connection between the development roller shaft 25*j* and the electrical contact of the apparatus main assembly 100A. In comparison, the development roller rear bearing 13 in this embodiment is formed with the use of a two color molding method as shown in FIG. 11. Therefore, it makes it possible to apply development bias voltage V to the development roller shaft 25*j* from the electrical power source (unshown) of the apparatus main assembly 100A, without requiring such a component as the abovementioned piece of electrically conductive plate 13*e*. That is, this embodiment can reduce the process cartridge 7 in cost by eliminating such a component as the piece of electrically conductive plate 13*e*.

Next, referring to FIG. 1, the regulation of the development roller shaft 25*j* and the follower portion 21 of the Oldham's coupling 20 in terms of their movement in the direction parallel to their axial line is described. The diameter L1 of the lengthwise rear end portion of the development roller shaft 25*j* is smaller than the diameter L2 of the main portion of the development roller shaft 25*j*. Thus, there is a step between the lengthwise end portion and main portion of the development roller shaft 25*j*. This stepped portion of the development roller shaft 25*j* functions as a bumping (regulating) portion 25*k*.

The through hole portion 13*b* is provided with a first area C of contact, which is the first to come into contact with the step portion 25*k* (regulating portion) of the development roller shaft 25*j* to catch the load F1 applied to the development roller rear bearing 13 by the development roller shaft 25*j*, when the development roller shaft 25*j* is moved rearward (when the process cartridge 7 is installed into the apparatus main assembly 100A). The opposite side of the through hole portion 13*b* from the first area C of contact in terms of the direction parallel to the axial line of the development roller 25, is provided with the second area D of contact, with which the inward surface 21*b* (inward end surface of coupling 20) of the follower portion 21 of the Oldham's coupling 20 comes into contact when the follower portion 21 is subjected to the load F2 by the coupling 53 of the apparatus main assembly 100A.

The load F1 is the amount of force to which the first area C of contact is subjected when the inward movement of the development roller 25, in terms of the direction parallel to the axial line of the development roller 25, is regulated, or the process cartridge 7 is dropped, for example. The load F2 is the amount of force to which the second area D of contact is subjected, through the follower portion 21 of the Oldham's coupling 20, by the coupling 50 of the apparatus main assembly 100A, when the coupling 53 of the main assembly engages with the Oldham's coupling 20 of the development unit 4 during the insertion of the process cartridge 7 into the apparatus main assembly 100A.

The through hole portion 13*b*, which is the second portion of the development roller rear bearing 13, is provided with two locking portions S1 and S2 for preventing the through hole portion 13*b* of the rear bearing 13 from separating from the base portion 13*a*, or the first portion of the bearing 13, when the bearing 13 is subjected to the lead F1 or F2.

The locking portions S1 and S2 are positioned so that they overlap with the base portion 13*a* of the developer roller rear bearing 13 in terms of the direction perpendicular to the axial line of the development roller 25 (direction perpendicular to axis of the hole of through hole portion 13*b*). In this embodiment, the entirety of locking portions S1 and S2 overlap with the base portion 13*a* of the bearing 13. However, this embodiment is not intended to limit the present invention in terms of the shape, number, and location of the locking portions.

The contact between the locking portions S1 and S2 with the development roller rear bearing 13 prevents the through hole portion 13*b* of the development roller rear bearing 13 from separating from the base portion 13*b* of the bearing 13, when the through hole portion 13*b* is subjected to the loads F1 or F2.

Figure 14:
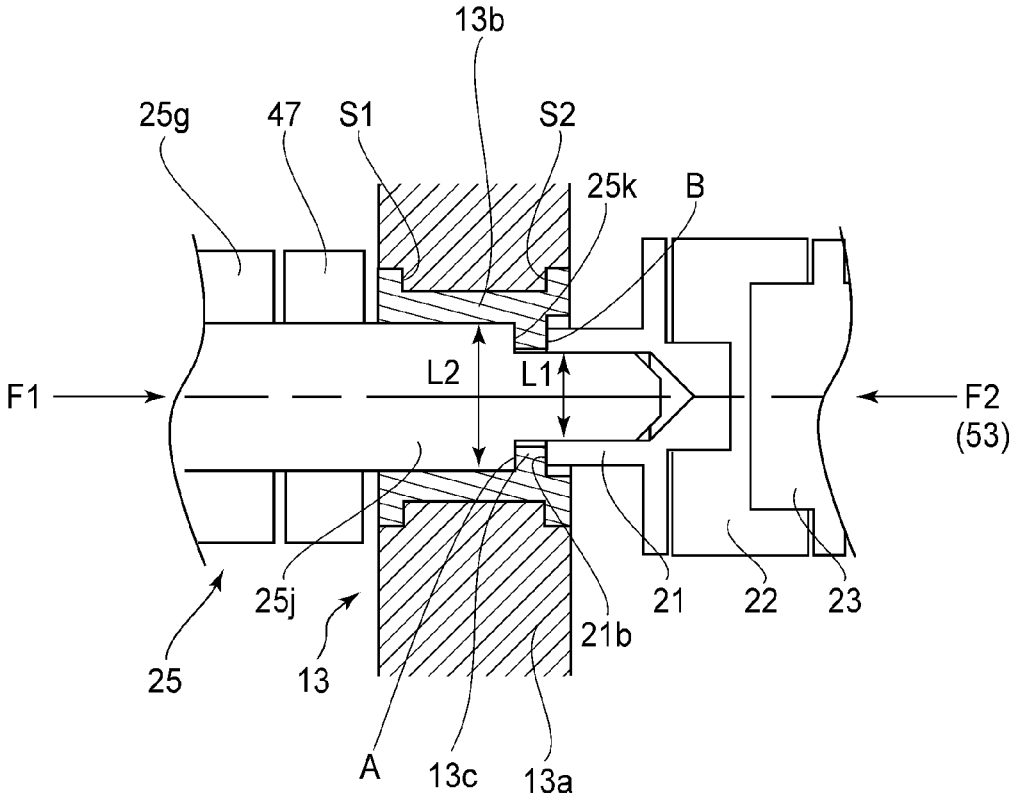
FIG. 14 is a sectional view of a combination of the rear bearing for the development roller, the rear end portion of the development roller, and the development roller coupling, in the first embodiment of the present invention, at a plane which coincides with the axial line of the development roller. It describes the structure of the combination.

Next, referring to FIG. 14, a regulating portion 13*c*, with which the development roller rear bearing 13 is provided, is described. The regulating portion 13*c* protrudes inward of the wall of the through hole of the through hole portion 13*b*. It regulates the development roller shaft 25*j* and the follower portion 21 of the Oldham's coupling 20 in terms of their movement in the direction of their axial line.

More specifically, the development roller shaft 25*j* is shaped so that the diameter L1 of its rear end portion is substantially smaller than the diameter L2 of its main portion; a step 25*k* is present between the rear end portion and main portion of the development roller shaft 25*j*. Further, the development roller shaft 25*j* is shaped so that after the insertion of the development roller shaft 25*j* into the through hole of the through hole portion 13*b* of the development roller rear bearing 13, the step 25*k* is within the through hole. Thus, as the through hole portion 13*b* is subjected to the load F1 by the development roller shaft 25*j*, the step 25*k* comes into contact with the first surface A of contact of the regulating portion 13*c*, whereby the development roller shaft 25*j* is regulated in its rearward movement parallel to its axial line; the development roller 25 is regulated in its rearward movement.

Similarly, as the follower portion 21 is subjected to the load F2 by the coupling 53 of the main assembly 100A, the inward surface 21*b* of the follower portion 21 (of development roller coupling 20) comes into contact with the second surface B of contact of the regulating portion 13*c*, being thereby regulated in its movement.

Referring to FIG. 14, because the through hole portion 13*b* of the development roller rear bearing 13 is provided with the regulating portion 13*c*, the development roller shaft 25*j* is supported by the portion of the development roller shaft 25*j*, the diameter of which is L2, by the through hole portion 13*b*. That is, unlike the structural arrangement for the rear end portion of the development unit 4, which is shown in FIG. 1, this arrangement can support the development roller shaft 25*j* by the portion of the development roller shaft 25*j*, the diameter of which is L2, which is larger than the diameter L1 of the end portion of the development roller shaft 25*j*.

Embodiment 2

Next, referring to FIG. 12, another embodiment of the present invention is described. In terms of the structure of the image forming apparatus 100, and the structure of the process cartridge 7, this embodiment is the same as the first embodiment. Thus, they will not be described here.

FIG. 12 shows an example of the through hole portion 13*b* of the development roller rear bearing 13, which is different in the shape of the locking portion, from the one shown in FIG. 14. In this embodiment, the locking portion is an integral part of the through hole portion 13*b* and is on the inward surface of the through hole portion 13*b*, in terms of the radius direction of the through hole portion 13*b*.

The regulating portion 13*c*, which projects into the through hole of the through hole portion 13*b* is subjected to both the loads F1 and F2 which apply in the direction of the axial line of the development roller 25. The loads F1 and F2 in this embodiment are the same as those in the first embodiment. Therefore, they will not be described here. In this embodiment, the through hole portion 13*b* of the development roller rear bearing 13 is provided with only one locking portion S1, which fits into the corresponding groove cut in the inward surface of the base portion 13*a* of the development roller rear bearing 13. Thus, the problem that as the through hole portion 13*b* is subjected to the loads F1 or F2, the through hole portion 13*b* of the development roller rear bearing 13 becomes separated from the base portion 13*a* of the development roller rear bearing 13.

EFFECTS OF PRESENT INVENTION

According to the present invention, the through hole portion of the development roller rear bearing is provided with multiple locking portions (or one) for keeping the through hole portion locked with the base portion of the development roller rear bearing, and the locking portions are shaped and positioned in such a manner that they overlap with the base portion of the development roller rear bearing, in terms of the direction perpendicular to the axial line of the through hole. Therefore, even when the regulating portion is subjected to the force which comes from within, or outside of, the process cartridge, the through hole portion is prevented from separating from the base portion. Further, the through hole portion of the development roller rear bearing, which is the second portion of the development roller rear bearing, is provided with a regulating portion (regulating surfaces), which protrudes into the through hole of the development roller rear bearing. Therefore, the development roller shaft can be supported by the portion of the rear end portion of development roller shaft, which is the same in diameter than the main portion of the development roller shaft.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 091813/2012 filed Apr. 13, 2012, which is hereby incorporated by reference.

What is claimed is:

1. A developing unit for an electrophotographic image forming apparatus, said developing unit comprising:

a developing roller, having a shaft member, for developing an electrostatic latent image formed on an electrophotographic photosensitive drum using developer; and a bearing for rotatably supporting said shaft member, said bearing including a bearing base portion of a first resin molded material and a bearing portion of a second resin molded material different from the first resin molded material, said bearing portion having a through-hole, wherein said bearing portion includes a contact portion contacting a stepped abutting portion of said shaft member, and a retaining portion overlapping with said bearing base portion in an axial direction of said shaft member.

2. A developing unit according to claim 1, further comprising a transmission member, provided at one end portion side of said shaft member with respect to the axial direction, for transmitting a driving force from the apparatus to said shaft member, wherein said bearing portion includes a second contact portion contacting an end surface of said transmission member, and a second retaining portion overlapping with said bearing base portion in the axial direction of the shaft member.

3. A developing unit according to claim 2, wherein said transmission member includes an Oldham coupling.

4. A process cartridge detachably mountable to the electrophotographic image forming apparatus, said process cartridge comprising the electrophotographic photosensitive drum and a developing unit according to claim 1.

5. An electrophotographic image forming apparatus comprising a process cartridge according to claim 4 to form an image on a recording material.

6. A developing unit according to claim 1, wherein said transmission member includes an Oldham coupling.

7. A developing unit for an electrophotographic image forming apparatus, said developing unit comprising:

a developing roller, having a shaft member, for developing an electrostatic latent image formed on an electrophotographic photosensitive drum using developer;

a bearing for rotatably supporting said shaft member, said bearing including a bearing base portion of a first resin molded material and a bearing portion of a second resin molded material different from the first resin molded material, said bearing portion having a through-hole; and a transmission member, provided at one end portion side of said shaft member with respect to an axial direction of said shaft member, for transmitting a driving force from the apparatus to said shaft member, wherein said bearing portion includes a contact portion contacting an end surface of said transmission member, and a retaining portion overlapping with said bearing base portion in the axial direction of said shaft member.

8. A developing unit according to claim 7, wherein said transmission member includes an Oldham coupling.

9. A process cartridge detachably mountable to the electrophotographic image forming apparatus, said process cartridge comprising the electrophotographic photosensitive drum and a developing unit according to claim 7.

10. An electrophotographic image forming apparatus comprising a process cartridge according to claim 9 to form an image on a recording material.

11. A developing unit for an electrophotographic image forming apparatus, said developing unit comprising:

a developing roller for developing an electrostatic latent image formed on an electrophotographic photosensitive drum using developer;

a shaft member, having a stepped abutting portion, for transmitting a driving force from an electrophotographic image forming apparatus to said developing roller;

a bearing for rotatably supporting said shaft member, said bearing including a bearing base portion of a first resin molded material and a bearing portion of a second resin molded material different from the first resin molded material, said bearing portion having a through-hole; and a transmission member, provided in one end portion side of said shaft member with respect to an axial direction thereof, for transmitting a driving force from a main assembly drive transmission member provided in the apparatus to said shaft member, wherein said bearing portion includes a limiting portion for limiting said stepped abutting portion of said shaft member and an end surface of said transmission member in the axial direction of said shaft member, and a plurality of retaining portions overlapping with said bearing base portion in the axial direction of said shaft member.

12. A process cartridge detachably mountable to the electrophotographic image forming apparatus, said process cartridge comprising the electrophotographic photosensitive drum and a developing unit according to claim 11.

13. An electrophotographic image forming apparatus for forming an image of a recording material, said apparatus comprising a process cartridge according to claim 12.

* * * * *